US006273077B1

(12) United States Patent
Wild

(10) Patent No.: US 6,273,077 B1
(45) Date of Patent: Aug. 14, 2001

(54) METHOD AND APPARATUS FOR OPERATION OF AN INTERNAL COMBUSTION ENGINE, ESPECIALLY OF A MOTOR VEHICLE, WITH A LEAN FUEL/ AIR MIXTURE

(75) Inventor: Ernst Wild, Oberriexingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/510,454

(22) Filed: Feb. 22, 2000

(30) Foreign Application Priority Data

Feb. 26, 1999 (DE) ..... 199 08 401

(51) Int. Cl.[7] ..... F02D 41/04; F02D 41/14

(52) U.S. Cl. ..... 123/679; 123/443; 701/109

(58) Field of Search ..... 123/443, 295, 123/305, 568.11, 568.13, 478, 480, 679, 698; 73/118.1, 118.2, 117.3; 701/103, 104, 105, 108, 109

(56) References Cited

U.S. PATENT DOCUMENTS 4,995,258 * 2/1991 Frank ..... 73/118.2
5,140,850 * 8/1992 Ellmann et al. ..... 73/118.2

FOREIGN PATENT DOCUMENTS 197 56 919 A1 10/1998 (DE) .
0-454191-A1 * 10/1991 (EP) ..... 73/118.2

* cited by examiner

*Primary Examiner*—Willis R. Wolfe
(74) *Attorney, Agent, or Firm*—Michael J. Striker

(57) ABSTRACT

The method of operating an internal combustion engine, especially of a motor vehicle, having a combustion chamber (4), which is operable in a plurality of combustion cycles, includes feeding an air mass (42) and a fuel mass (3) into the combustion chamber (4) in each combustion cycle; adjusting a mixture composition lambda (λ) of the air mass to the fuel mass for one of the combustion cycles so that λ>1; determining a residual air portion present in the combustion chamber (4) due to combustion occurring in the combustion chamber in the combustion cycle in which the mixture composition lambda (λ) is greater than one; and reducing the air mass to be supplied to the combustion chamber (4) in another combustion cycle following the one combustion cycle in which λ>1 by about the residual air portion found in the one combustion cycle. The portion of the residual air in the combustion chamber is exactly accounted for in determining fuel/air stoichiometry during combustion in this method so that engine operation and exhaust gas composition are improved. The invention also includes an control unit and/or control element of a control unit that is operable to perform this method.

12 Claims, 4 Drawing Sheets

METHOD AND APPARATUS FOR OPERATION OF AN INTERNAL COMBUSTION ENGINE, ESPECIALLY OF A MOTOR VEHICLE, WITH A LEAN FUEL/AIR MIXTURE

BACKGROUND OF THE INVENTION

1. Field of the Invention

The present invention relates to a method of operating an internal combustion engine, especially of a motor vehicle, in which an air mass and a fuel mass are fed into a combustion chamber in a combustion cycle, wherein the mixture composition ratio (lambda) of the air mass to the fuel mass is pre-adjustable. Further it also relates to a suitable control unit for this type of internal combustion engine.

2. Prior Art

In conventional combustion engines the air mass required for combustion is fed through an intake pipe to the combustion chamber. The fuel mass required for the combustion is similarly supplied to the combustion chamber by means of a fuel pipe and suitable injection valves in these engines or with direct gasoline injection (BDE) via a fuel intermediate reservoir (fuel rail), in which the highly compressed fuel is present at about 100 bar, in modern gasoline motors or diesel engines.

In an older previously published DE application (AZ R 32348-1) of the present inventor a method and apparatus for determination of the gas fill of a combustion engine is described. The gas mixture contained in the intake pipe is composed of fresh gas and exhaust gas. A process is described in this reference for determining the fresh gas portion in the gas flowing into the combustion chamber in order correspondingly to be able to exactly measure the amount of fuel to be made available for the combustion. To solve this problem the partial pressure of the fresh gas portion in the total mass flow flowing into the combustion chamber is determined by setting up a mass balance condition and then taking the time derivative of the general gas equation. This separate balancing of the fresh gas and the exhaust gas provides the advantage that the filled fresh gas volume can be exactly determined. The subject matter of the present patent application only concerns the residual air found in the exhaust pipe because of an external exhaust gas feedback, generally not to the internal residual gas present in the combustion chamber.

In the known internal combustion engine, especially combustion engines, the air portion in the residual gas still found in the residual gas after each combustion cycle is left completely out of consideration. Furthermore it is usually assumed that no residual air will be found in the residual gas from the combustion chamber. Of course considerable errors are thus present in the stoichiometry of air and fuel taken into the combustion cycle.

Furthermore in modem combustion engines with a 3-way exhaust gas catalyzer lean operation (lamba$\geqq$1) is basically avoided, since the nitrogen oxides (NOx) greatly increase during lean operation, which then enter the catalyzer and reduce its service life. However in contrast, the newest catalyzers also permit lean operation, since NOx fed into one of these catalyzers is reduced to $N_2$ and $O_2$ again by rich operation of the engine with λ(lambda)<1. On account of this new catalyzer engineering advance gasoline engines may now be operated like Diesel engines, which besides has considerably improved the development of the BDE combustion engines.

SUMMARY OF THE INVENTION

It is an object of the present invention to provide a method and apparatus for operation of the above-mentioned internal combustion engine, which overcomes the above-described disadvantages and permits an exact knowledge of the stoichiometry of the fuel/air mixture during combustion.

It is especially an object of the present invention to be able to exactly account for the portion of residual air in the respective mixture composition still found in the residual gas in the combustion chamber in lean operation.

The above-described objects of the invention are attained in a method, in which the portion of residual air present in the combustion chamber after combustion has occurred in the combustion chamber is determined in a combustion cycle with a mixture composition lambda λ greater than 1 and the air mass fed to the combustion chamber in the combustion cycle following that is reduced by about that portion of residual air. The invention thus is based on the concept of considering the residual air available for a respective following combustion cycle in the λ(lambda) determination.

The method of the invention thus includes the following method steps:

a) establishing the presence of a combustion cycle with a mixture ratio, λ(lambda), of air/fuel>1;

b) determining a residual air portion remaining in the combustion chamber after combustion has occurred in the combustion chamber during the combustion cycle in which λ(lambda)>1; and c) reducing the air mass fed into the combustion chamber through the intake pipe in a combustion cycle following the combustion cycle in which λ(lambda)>1 by about the residual air portion determined in step b).

The method according to the present invention thus takes the air portion in the residual gas into account and thus guarantees a more exact control of λ(lambda) than in the state of the art and thus an improved exhaust gas and vehicle operation.

It should be emphasized that the present invention is not limited to BDE-operated internal combustion engines, but fundamentally includes engines, which have an NOx-fit catalyzer, i.e. also those engines with conventional fuel injection with a λ(lambda) of about 1.6.

The control unit according to the invention, in an internal combustion engine having means for feeding an air mass and fuel mass into the combustion chamber, comprises means for controlling the mixture composition lambda λ of air mass to fuel mass, means for establishing the presence of a combustion cycle with a mixture combustion lambda, λ, >1; means for determining a residual air portion in the combustion cycle in which λ(lambda)>1 after combustion has occurred in the combustion chamber prior to that cycle and means for calculating a reduced air mass to be fed into the combustion chamber through the intake pipe in a combustion cycle following that cycle approximately from the residual air portion determined to be present after combustion in the aforesaid combustion cycle in which λ(lambda) >1.

BRIEF DESCRIPTION OF THE DRAWINGS

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
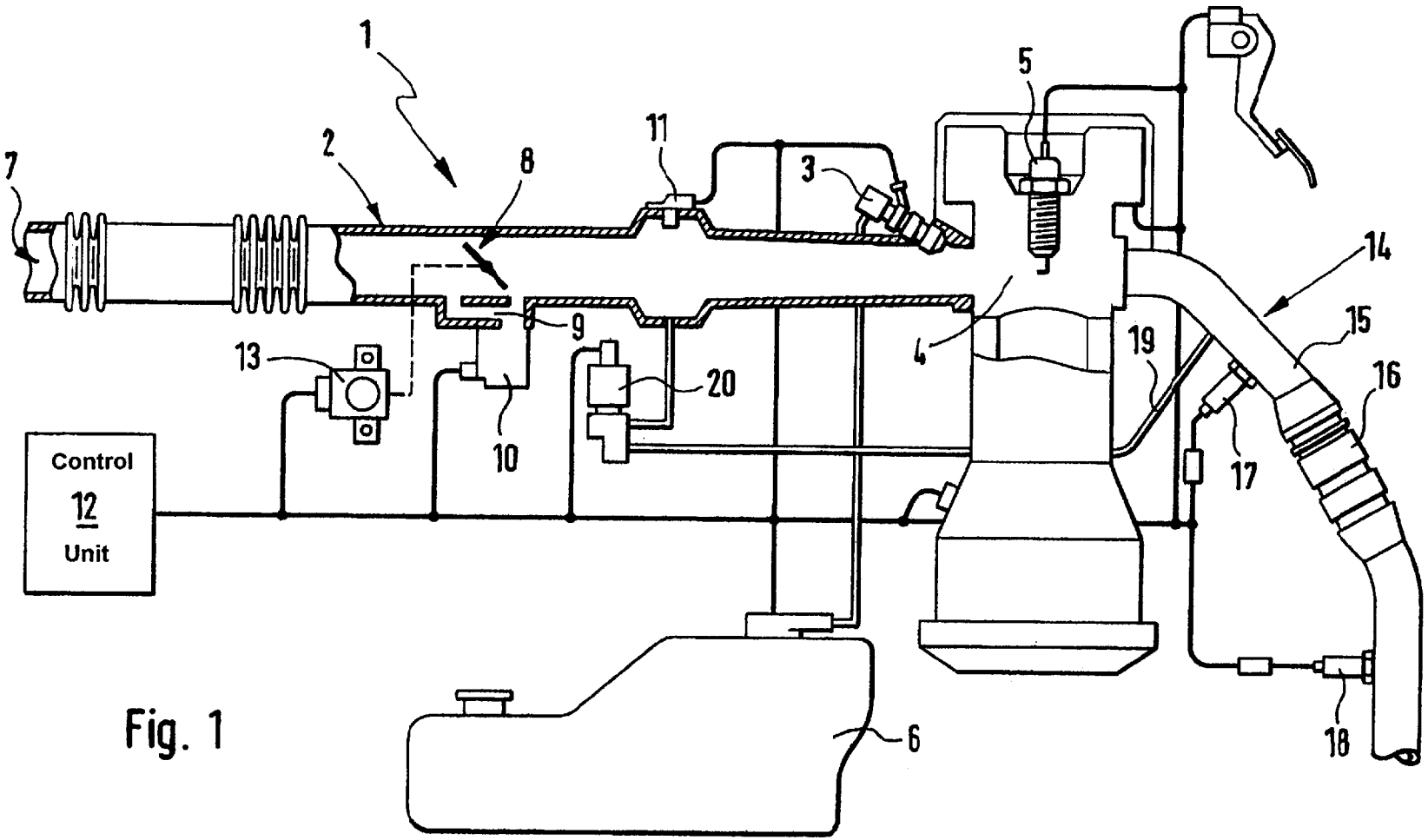
FIG. 1 is a schematic diagram showing parts of a conventional combustion engine including a combustion chamber, an intake pipe, sensor devices and butterfly valve, in which the method according to the invention and control unit of the invention may be used.

The internal combustion engine 1 illustrated schematically in FIG. 1 has an intake pipe 2, which is connected with a combustion chamber 4 of the engine 1 by means of injection valves, of which only one injection valve 3 is illustrated in partial cross-section. The various injection valves are associated with a fuel distributor, which is not shown in the drawing and which controls the individual valves in synchronization with the ignition of the fuel/air mixture. The ignition occurs in each of the combustion chambers 4 by means of a respective spark plug 5, which cooperates with an unshown corresponding ignition coil. The fuel is supplied to the individual injection valves by a tank unit 6 via a fuel intermediate reservoir (fuel rail) which is not shown in the drawing.

The supply of air into the intake pipe 2 occurs through an opening 7. In the intake pipe 2, in the vicinity of the opening 7, a throttle 8 is provided, by means of which the airflow in the intake pipe 2 is regulated. A supply of air to the intake pipe 2 sufficient for idle operation of the engine 1 is guaranteed by means of an additional bypass pipe 9. The control of the bypass pipe 9 occurs by means of an idle plate device arranged in the vicinity of the bypass pipe 9.

A pressure sensor 11 is provided in the intake pipe 2, which is equipped to measure the pressure present in the intake pipe 2. The signal generated by the pressure sensor 11 is fed into an electronic control unit 12. The output signal of the idle plate device 10 is similarly fed to the electronic control unit 12. Furthermore the position of the throttle 8 is determined by means of a throttle potentiometer 13 and the corresponding measured throttle position signal is similarly input to the electronic control unit 12.

The exhaust gas produced by the combustion is conducted outside the engine by means of an exhaust gas assembly 14. A catalyzer 16 is arranged in the exhaust pipe 15. Furthermore two lambda probes 17, 18 are provided upstream and downstream of the catalyzer 16, which cooperate with a lambda regulator or control means, which is preferably integrated into the electronic control unit 12.

According to the OBD-II Rules a continuous monitoring of the catalyzer operating performance takes place. In addition the second probe 18 must be installed downstream of the catalyzer 16. A comparison of the probe signals from upstream and from downstream of the catalyzer 16 produces information regarding the catalyzer efficiency. Since the second probe 18 arranged downstream of the catalyzer is better protected from damaging exhaust gas components than the first probe 17, appearance of age-related changes in the first probe 17 can be corrected.

The lambda controller or control means should adjust the mixture in the combustion chamber 4 so that the catalyzer operates in an optimum manner and thus maintain the legally established exhaust gas limits. The catalyzer 16 thus has the purpose to convert the three exhaust gas ingredients CO, HC and NOx into $CO_2$, $H_2O$ and $N_2$. Both lambda probes 17, 18 measure the difference between the oxygen concentration in the surrounding air and the oxygen concentration in the exhaust gas. Thus the respective measured signal from the probe 17,18 is a direct measure of the air portion in the exhaust gas. Because of a catalytic coating an incompletely burned mixture at the probe surface is continuously reacted.

As has already been stated, the lamba control means should guarantee that an optimum air portion is always present in the exhaust gas. In addition the lambda controller changes only the fuel mass injected into the combustion chamber. The air mass fed into the combustion chamber 4 and the ignition in the combustion chamber are therefore not influenced. Optimal control of the exhaust gas composition is obtained by continuous oscillation about the region of λ(lambda)=1.

It has already been stated that the catalyzer has a considerable storage capacity for oxygen. Also the catalyzer 16 has optimum efficiency only in a very narrow range from λ(lambda)=0.995 to 0.999. Thus, particularly in lean operation of the engine with λ(lambda)>1, the rapid regeneration of the catalyzer 16 (co-called "Cat-clear") is necessary in controlled time intervals, with the help of additionally injected fuel. Furthermore the controlling position of the lambda control means is shifted in the direction of "rich" by appropriate pre-control measures. After a certain exhaust gas has passed through, the enrichment is eliminated.

From FIG. 1 it is apparent that a portion of the exhaust gas fed through the exhaust gas assembly 14 toward the outside is again fed back to the intake pipe 2 by means of an exhaust gas feedback line 19 and a corresponding exhaust gas feedback valve 20.

Figure 2:
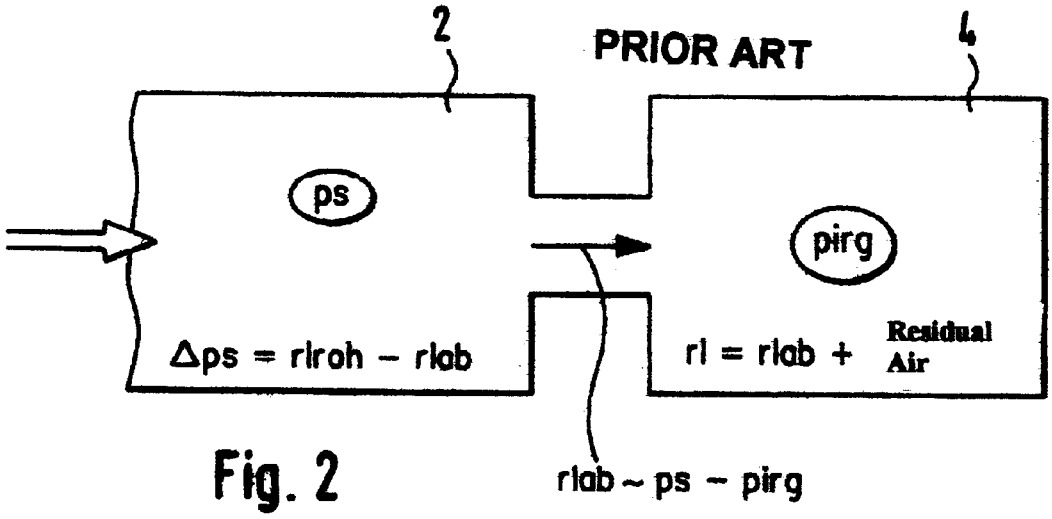
FIG. 2 is a schematic block diagram of an intake pipe and a combustion chamber for illustration of air feed relationships according to the state of the art.

FIG. 2 shows a schematic block diagram of an intake pipe and a combustion chamber for illustration of the air feed relationships according to the state of the art. The change in intake pressure, Δps, results from the difference of the air mass fed into the intake pipe 2, rlroh, and the air mass, rlab, conducted into the combustion chamber 4 from the intake pipe 2. With a partial pressure of residual gas pirg in the combustion chamber 4 the air mass rlab conducted into the combustion chamber is proportional to the difference of the intake pressure ps and the partial pressure of the residual gas pirg in the combustion chamber. According to the invention in lean operation of the engine 1 the entire air mass present in the combustion chamber 4 per cycle is the sum of the air mass rlab fed from the intake pipe 2 and the residual air portion still present from the past combustion cycles because of the lean operation.

Figure 3:
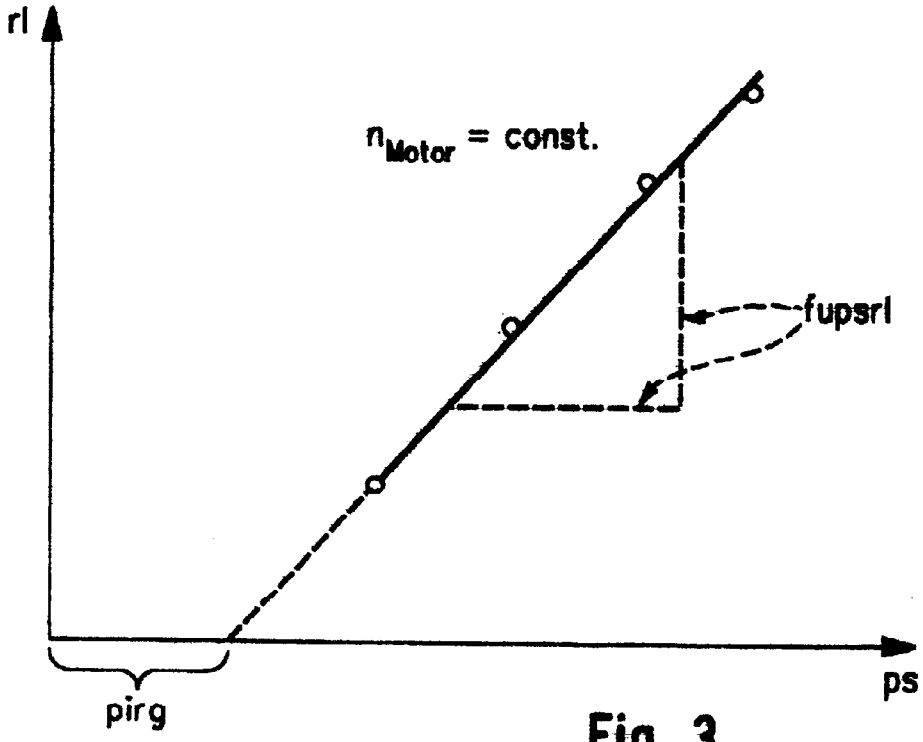
FIG. 3 is a graphical illustration of a typical dependence of the air mass in the combustion chamber rl and the intake pipe pressure ps.

The typical mathematical relationship shown in FIG. 3 between the air filling into the combustion chamber rl and the intake pressure ps is described by a straight line with an intercept and increasing slope. The intercept value is interpreted as an inert gas portion. The increasing slope corresponds to the constant fupsrl for recalculation of the pressure from the mass, and vice versa. This linear relationship is valid only for complete combustion of the air in the combustion chamber.

Figure 4:
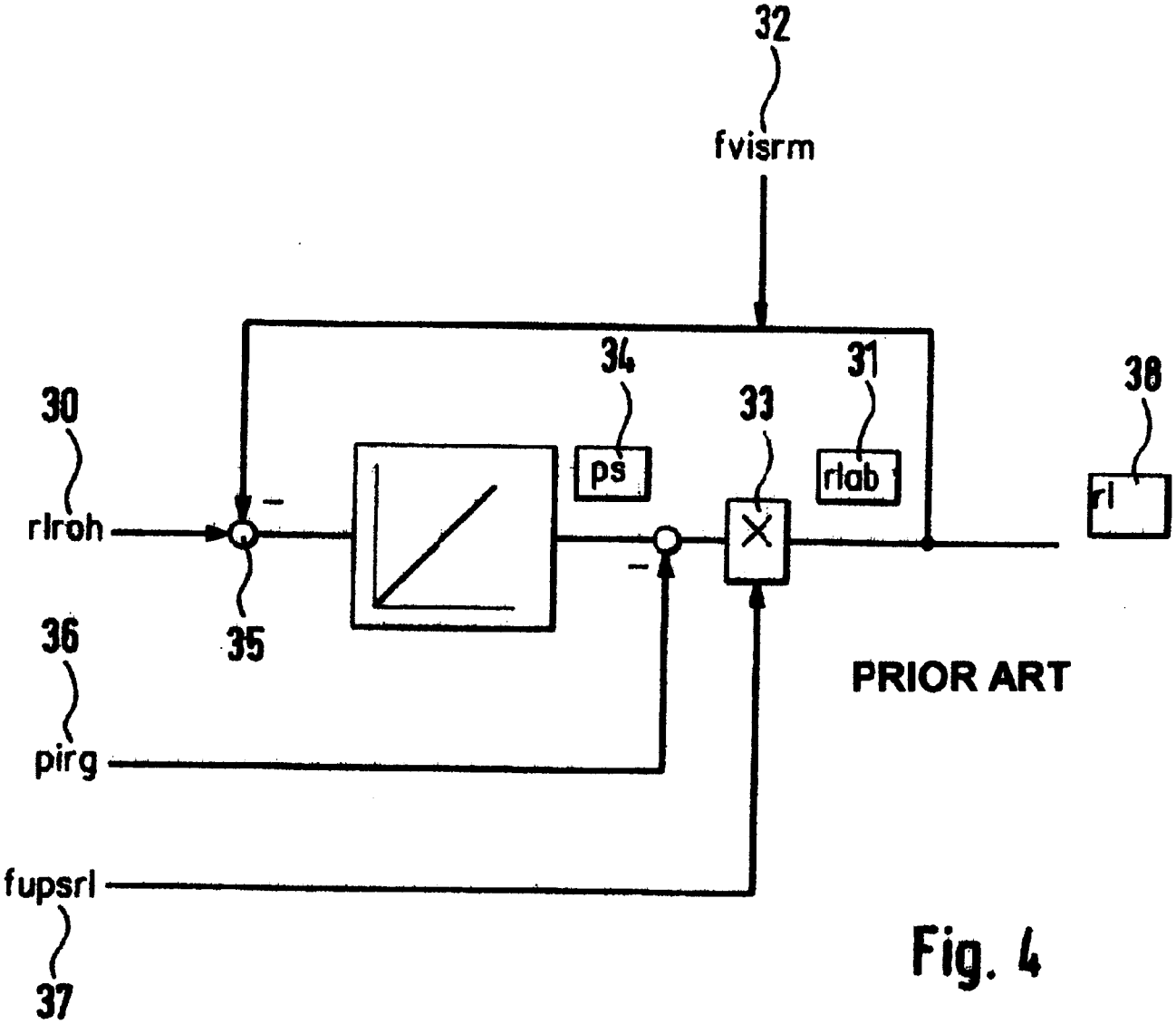
PRIOR ART Fig. 4
FIG. 4 is a block diagram of the air distribution in a conventional internal combustion engine in operation with λ(lambda) less than or equal to 1.

A procedure according to the prior art for determination of the air mass flowing out of the combustion chamber is shown in FIG. 4. The difference per cycle of the air mass rlroh 30 flowing into the combustion chamber and the air mass rlab 31 flowing out of the intake pipe into the combustion chamber is converted into an intake pipe pressure change by the conversion factor fvisrm 32 and is added or integrated 35 into the previous intake pressure ps 34 according to equation (1):

$$ps_new=ps_old+fvisrm*(rloh-rlab) \quad (1).$$

The air mass rlab 31 flowing into the combustion chamber is proportional to the difference in the intake pressure ps 34 and the partial pressure of the residual gas pirg 36 in the combustion chamber according to equation (2):

$$rlab=fupsryl*(ps-pirg) \quad (2),$$

wherein fupsrul 37 is a factor for converting pressure to mass.

With the assumption used in the procedure according to the state of the art, namely that no residual air portion is present in the combustion chamber, the air mass in the combustion chamber rl 38 corresponds to the air flowing out of the intake pipe, i.e. the relationship shown in equation (3) below is valid:

$$rl=rlab \quad (3).$$

Figure 5:
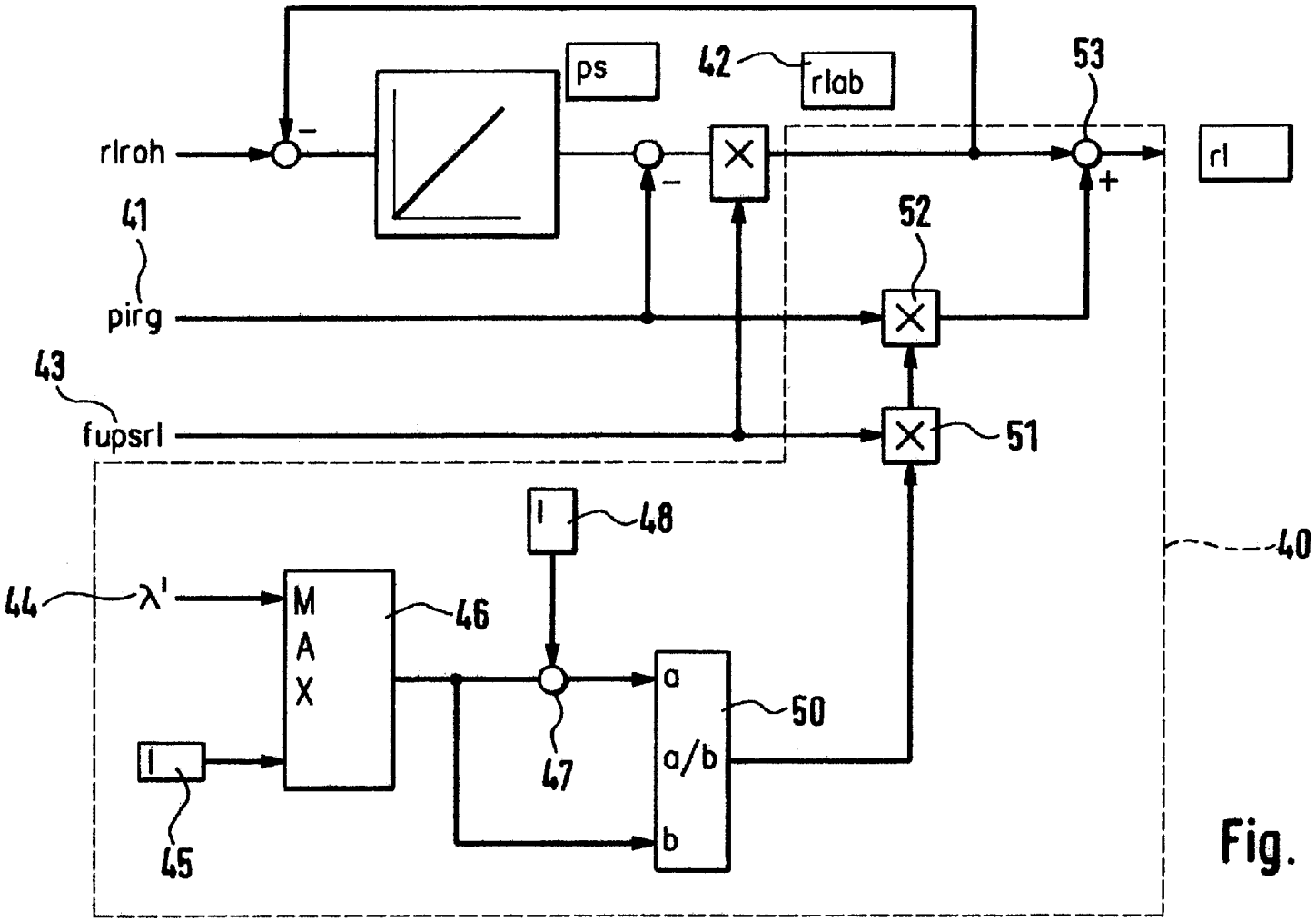
FIG. 5 is a block diagram similar to that of FIG. 4 for a combustion engine in lean operation with λ(lambda) greater than one.

The block diagram shown in FIG. 5 now illustrates the corresponding procedure according to the method of the invention for determination of the mixture composition lambda λ for lean operation in which λ>1. Functional components according to the invention are shown separated from those of the prior art shown in FIG. 4 by means of dashed lines 40. During lean operation not all the oxygen in the combustion chamber is burned. The residual gas partial pressure pirg remaining in the combustion chamber is thus composed of air and inert gas. The air partial pressure pirgl in this residual gas depends now on the mixture composition lambda λ' of the previous combustion and is given by equation (4):

$$pirgl=\{(\lambda'-1)/\lambda'\}*pirg \quad (4).$$

However it should be emphasized that equation (4) is only valid for lean operation, i.e. λ'(lambda')>1.

In lean operation the air portion in the residual gas is added to the air mass rlab 42 flowing from the intake pipe, which is calculated from the partial pressure pirgl of the air faction in the residual gas with the conversion factor fupsrl, i.e. according to equation (5):

$$rl=rlab+fupsrl*pirgl \quad (5).$$

According to the invention first λ' (lambda') 44, i.e. the lambda value of the respective previous combustion cycle', is compared with "1" 45 and with the aid of a maximum operational element 46, whether or not lean operation with λ' (lambda')>1 is occurring is determined. In the case of lean operation the quotient (λ'−1)/λ' is now formed in additional operational element 50 from the value λ (lambda') minus a "1", which is supplied from element 48 and subtracted from λ' (lambda') in element 47, and λ' (lambda'). However in cases in which a "1" is present at the output of the maximum operational element 46, then a "0" is output from the additional operational element 50. The value present at the output of the additional functional element 50 is first fed to a first multiplier 51, where a multiplication with the conversion factor, fupsrul, occurs according to equation (5), and after that the product is fed to a second multiplier 52, by means of which the product with pirg is formed according to equation (4). Subsequently the value fupsrl*pirgl according to equation (5) is fed to the adder 53, in which this value is added to rlab, so that finally the value of rl, i.e. the air mass present in the combustion chamber results.

The embodiment of the method according to the invention in the form of a control element, which is provided for a control unit of an internal combustion engine, especially for a motor vehicle, is of special significance. In that embodiment a program is stored in a control element, which is executable in a computer device, especially a microprocessor and is suitable for performing the method according to the invention In this case also the invention is embodied by a program stored in the control element, so that this control element provided with the program in the same manner as the method described above is suitable for performing the method of the invention. An electrical storage medium, especially a read-only-memory, can be used as the control element.

The disclosure in German Patent Application 199 08 401.7 of Feb. 26, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method and apparatus for operating an internal combustion engine, especially of a motor vehicle, with a lean fuel/air mixture, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A method of operating an internal combustion engine, especially of a motor vehicle, having a combustion chamber (4) and being operable in a plurality of combustion cycles, said method comprising the steps of:

a) feeding an air mass (42) and a fuel mass (3) into said combustion chamber (4) in each of said combustion cycles;

b) adjusting a mixture composition lambda (λ) of said air mass to said fuel mass in one of said combustion cycles so that said mixture composition lambda (λ) is greater than one; and c) determining a residual air portion present in said combustion chamber (4) due to combustion occurring in the combustion chamber in said one of said combustion cycles in which said mixture composition lambda (λ) is greater than one; and d) reducing an air mass to be supplied to said combustion chamber (4) in a subsequent one of said combustion cycles following said one of said combustion cycles in which said mixture composition lambda (λ) is greater than one by about said residual air portion determined in step c);

whereby the portion of the residual air in the combustion chamber is exactly accounted for in determining fuel/air stoichiometry in said combustion cycles and thus engine operation and exhaust gas composition are improved.

2. The method as defined in claim 1, further comprising calculating said residual air portion remaining after combustion from the residual gas partial pressure (pirg) in the combustion chamber by means of said mixture composition lambda (λ') for a previous one of said combustion cycles occurring prior to said one of said combustion cycles in which said mixture composition lambda (λ) is greater than one according to the following equation (4):

$$pirgl=\{(\lambda'-1)/\lambda'\}*pirg \quad (4),$$

wherein pirg is said residual gas partial pressure, pirgl is an air partial pressure in said residual gas and said λ' is said mixture composition lambda for said previous one of said combustion cycles.

3. The method as defined in claim 2, wherein said air mass (42) supplied to said combustion chamber (4) in said combustion cycles is set or adjusted by a lambda control means and said reducing of said air mass in said subsequent one of said combustion cycles by about said residual air portion occurs by means of said lambda control means.

4. The method as defined in claim 3, wherein an air mass (38) present in said combustion chamber (4) is determined from the following equation (5):

$$rl=rlab+fupsrl*pirgl \quad (5),$$

wherein rl is said air mass present in said combustion chamber (4), rlab represents said air mass (42) supplied to said combustion chamber (4), fupsryl is a conversion factor for converting pressure units into air mass units and pirgl is said air partial pressure in said residual gas.

5. The method as defined in claim 3, further comprising providing an intake pipe (2) for the combustion chamber (4) of the internal combustion engine and reducing an air mass fed into the intake pipe (2) according to a reduction in said air mass supplied to the combustion chamber (4).

6. A control element for a control unit of an internal combustion engine, especially of a motor vehicle, said internal combustion engine having a combustion chamber (4) and being operable in a plurality of combustion cycles, wherein said control element includes means for storing a program executable by a computer device, wherein said program includes steps for performing a method of operating the internal combustion engine comprising the steps of:

a) feeding an air mass (42) and a fuel mass (3) into said combustion chamber (4) in each of said combustion cycles;

b) adjusting a mixture composition lambda (λ) of said air mass to said fuel mass in one of said combustion cycles so that said mixture composition lambda (λ) is greater than one; and c) determining a residual air portion present in said combustion chamber (4) due to combustion occurring in the combustion chamber in said one of said combustion cycles in which said mixture composition lambda (λ) is greater than one; and d) reducing an air mass to be supplied to said combustion chamber (4) in a subsequent one of said combustion cycles following said one of said combustion cycles in which said mixture composition lambda (λ) is greater than one by about said residual air portion determined in step c);

whereby the portion of the residual air in the combustion chamber is exactly accounted for in determining fuel/air stoichiometry in said combustion cycles and thus engine operation and exhaust gas composition are improved.

7. The control element as defined in claim 6, wherein said means for storing said program comprises a read-only-memory and said computer device comprises a microprocessor.

8. A control unit for an internal combustion engine (1), especially of a motor vehicle, said internal combustion engine comprising a combustion chamber (4) and means for supplying an air mass (42) and a fuel mass (3) into the combustion chamber and is operable in a plurality of combustion cycles, wherein said control unit comprises means (12,16-18) for controlling a mixture composition lambda (λ) of said air mass to said fuel mass in each of said combustion cycles;

means (45,46) for establishing the presence of one of said combustion cycles in which said mixture composition lambda (λ) is greater than one;

means (12,50) for determining a residual air portion in said combustion chamber after combustion; and means for calculating a reduced air mass to be supplied to the combustion chamber (4) in another of said combustion cycles following said combustion cycle in which said mixture composition lambda is greater than one from said residual air portion;

whereby the portion of the residual air in the combustion chamber is exactly accounted for in determining fuel/air stoichiometry in said combustion cycles and thus engine operation and exhaust gas composition are improved.

9. The control unit as defined in claim 8, wherein said means for calculating said residual air portion remaining in said combustion chamber after said combustion cycle calculates said residual air portion from a residual gas partial pressure (pirg) and said mixture composition lambda (λ') of a previous one of said combustion cycles using the following equation (4):

$$pirgl=\{(\lambda'-1)/\lambda'\}*pirg \quad (4),$$

wherein pirg is said residual gas partial pressure, pirgl is an air partial pressure in said residual gas and said λ' is said mixture composition lambda for said previous one of said combustion cycles.

10. The control unit as defined in claim 8 or 9, further comprising means for cooperating with a lambda controller (12,16-18), said lambda controller comprising means for adjusting or setting said air mass (42) supplied to said combustion chamber (4) in said combustion cycle and means for adjusting or setting said air mass supplied to said combustion chamber in said following combustion cycle.

11. An internal combustion engine, especially of a motor vehicle, said internal combustion engine comprising a combustion chamber (4), means for supplying an air mass (42) and a fuel mass (3) into the combustion chamber and a control unit, wherein said control unit comprises means (12,16-18) for controlling a mixture composition lambda (λ) of said air mass to said fuel mass in the combustion chamber;

means (45,46) for establishing the presence of a combustion cycle in which said mixture composition lambda (λ) is greater than one;

means (12,50) for determining a residual air portion in said combustion chamber after combustion; and means for calculating a reduced air mass to be supplied to the combustion chamber (4) in another combustion cycle following said combustion cycle in which said mixture composition lambda is greater than one from said residual air portion;

whereby the portion of the residual air in the combustion chamber is exactly accounted for in determining fuel/air stoichiometry in said combustion cycles and thus engine operation and exhaust gas composition are improved.

12. An internal combustion engine, especially for a motor vehicle, said internal combustion engine comprising a combustion chamber (4), means for supplying an air mass (42) and a fuel mass (3) into the combustion chamber and a control element, said control element including means for storing a program executable by a computer device, wherein said program includes steps for performing a method of operating the internal combustion engine comprising the steps of:

a) feeding an air mass (42) and a fuel mass (3) into said combustion chamber (4) in said combustion cycles;

b) providing means for adjusting a mixture composition lambda (λ) of said air mass to said fuel mass in said combustion cycles; and c) determining a residual air portion present in said combustion chamber (4) due to combustion events occurring in the combustion chamber in one of said combustion cycles in which said mixture composition lambda (λ) is greater than one; and d) reducing an air mass to be supplied to said combustion chamber (4) in a subsequent one of said combustion cycles following said one of said combustion cycles in which said mixture composition lambda (λ) is greater than one by about said residual air portion determined in step c);

whereby the portion of the residual air in the combustion chamber is exactly accounted for in determining fuel/air stoichiometry in said combustion cycles and thus engine operation and exhaust gas composition are improved.

* * * * *